United States Patent [19]

Upchurch

[11] Patent Number: 4,576,234

[45] Date of Patent: Mar. 18, 1986

[54] FULL BORE SAMPLER VALVE

[75] Inventor: James M. Upchurch, Sugar Land, Tex.

[73] Assignee: Schlumberger Technology Corporation, New York, N.Y.

[21] Appl. No.: 727,609

[22] Filed: Apr. 29, 1985

Related U.S. Application Data

[63] Continuation of Ser. No. 419,251, Sep. 17, 1982, abandoned.

[51] Int. Cl.[4] ..... E21B 34/10; E21B 43/12

[52] U.S. Cl. ..... 166/319; 166/330; 166/332; 137/614.11; 137/614.21

[58] Field of Search ..... 166/264, 319, 332, 330; 175/234, 235; 137/614.11, 614.21, 614.18

[56] References Cited

U.S. PATENT DOCUMENTS

| | | | |
|---|---|---|---|
| 4,063,593 | 12/1977 | Jessup | 166/317 |
| 4,260,021 | 4/1981 | Mott | 166/317 |
| 4,317,490 | 3/1982 | Milberger | 175/234 |

*Primary Examiner*—Stephen J. Novosad
*Assistant Examiner*—Bruce M. Kisliuk

[57] ABSTRACT

In accordance with an illustrative embodiment of the present invention, a full-bore sampler and safety valve apparatus includes a housing having a hydraulically operable mandrel assembly slidably arranged therein, axially spaced, normally open ball valve elements mounted by trunnions on said mandrel assembly for rotation from positions simultaneously opening a flow passage through said mandrel assembly in one longitudinal position of said mandrel assembly to positions simultaneously closing said flow passage in another longitudinal position of said mandrel assembly, a first actuator member fixed with respect to said housing for applying closing torque to one ball valve as said mandrel assembly is shifted toward said other position, and a second actuator member movable relative to said housing and said mandrel assembly and operable in response to rotation of said one ball valve for applying closing torque to the other of said ball valves.

14 Claims, 10 Drawing Figures

FULL BORE SAMPLER VALVE

This application is a continuation of application Ser. No. 419,251, filed 09-17-82 now aban.

BACKGROUND OF THE INVENTION

1. Field of the Invention

This invention relates generally to drill stem testing tools, and particularly to a new and improved full bore sampler and safety valve apparatus for trapping a flowing sample of formation fluids that may be produced from an isolated well interval.

2. Background Art

A drill stem test may be considered to be a temporary completion of an earth formation that has been intersected by a well bore. A packer is run into the well on a pipe string and is set to isolate the interval of the well bore to be tested, and then a test valve is opened to permit fluids in the formation to flow into the bore hole and up into the pipe string to obtain an indication of the commercial potential of the well. Pressure data is recorded with the test interval open and then shut in, from which many useful parameters such as permeability and initial reservoir pressure can be determined. It also is desirable to collect an actual sample of the fluids for subsequent laboratory analysis.

A sampler that has been used for many years with great success is disclosed in Nutter U.S. Pat. No. 3,308,887, assigned to the assignee of this invention. As shown in FIG. 3B of this patent, the flow of formation fluid is routed through an annular chamber having sleeve valves at each end that simultaneously can be opened and closed. When the valves finally are closed at the end of the test, a flowing sample of the fluid being produced is entrapped at formation conditions of temperature and pressure. However, the testing apparatus shown in the Nutter patent has a barrier that blocks vertical access through the tool and which must be removed before other equipment such as a pressure recorder or a perforator can be run into the well.

A sampler valve that uses a pair of vertically spaced ball valves to simultaneously open and close the respective ends of a sample chamber is shown in U.S. Pat. No. 4,063,593. The device shown in this patent, while being full-bore, has a number of disadvantages. The ball valve elements move vertically within the housing during operation and are subject to cocking and high friction during movement from open to closed positions. These factors can cause less than adequate operation through improper sealing and closure. Moreover this system is not considered to be particularly sturdy and rugged in construction, which is a highly desirable feature in this type of equipment.

A ball valve of known construction utilizes a rotary actuator system of inner and outer threaded sleeves that are coupled to a ball valve element by push rods. Rotation of one sleeve relative to the other causes axial displacement of the sleeves and movement of the ball valve element between its open and closed positions. The requirement of rotary motion makes this system not particularly applicable to drill stem testing tools where movement of the drill stem during the testing operation should be avoided.

OBJECTS OF THE INVENTION

It is the general object of the present invention to provide a new and improved full-bore sampler valve for trapping the last flowing sample of formation fluids that are produced during a drill stem test.

Another object of the present invention is to provide a new and improved full-bore sampler apparatus that includes ball-type valve elements that are operated by an actuator system which applies high closing torque to provide a much more rugged and reliable apparatus than has been known in this art.

SUMMARY OF THE INVENTION

These and other objects are attained in accordance with the concepts of the present invention through the provision of a sampler valve apparatus comprising a housing having an axially shiftable mandrel assembly that carries spaced ball valve elements that when open present an unobstructed vertical passage and when closed block the open ends of a sample chamber for containing a discrete volume of formation fluids. A first actuator means on the housing applies closing torque to one of the ball valve elements as the mandrel assembly shifts toward one position, and a second actuator means applies closing torque to the other of the ball valve elements in response to closing movement of said first ball valve element. Each ball valve element has a recess opening outwardly to the side thereof at least partially receive a portion of its actuator means when the valves are rotated closed. Each ball valve element is mounted by trunnions on the mandrel assembly to provide an extremely sturdy and rugged construction which can be operated with minimum friction, and the unique actuator system employed engages transverse or outer peripheral edge portions of the recesses in the ball valve elements to apply very high closing torques thereto to provide a reliable closing action.

BRIEF DESCRIPTION OF THE DRAWINGS

The present invention has other objects, features and advantages that will become more clearly apparent in connection with the following detailed description of a preferred embodiment, taken in conjunction with the appended drawings in which.

DESCRIPTION OF A PREFERRED EMBODIMENT

Figure 1:
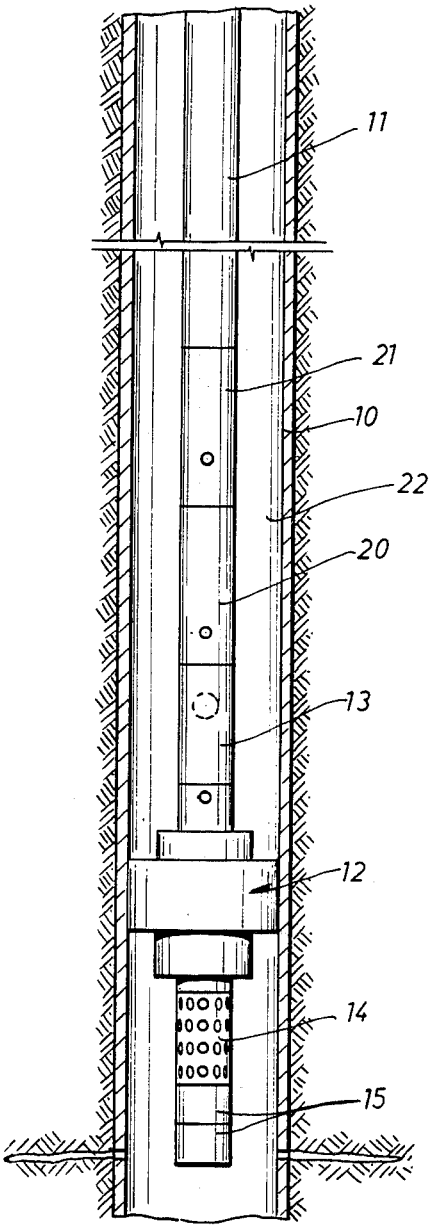
FIG. 1 is a schematic view of a string of drill stem testing tools positioned in a well being tested.

Referring initially to FIG. 1, there is shown schematically a string of drill stem testing tools suspended within the well casing 10 on drill pipe 11. The tools comprise a hook wall-type packer 12 that functions to isolate the well interval to be tested from the hydrostatic head of fluids thereabove, and a main test valve assembly 13 that functions to permit or terminate the flow of formation fluids from the isolated interval. The test valve 13 preferably is of a type that may be opened and closed in response to changes in the pressures of fluids in the annulus 22 between the pipe 11 and the casing 10. The valve assembly 13 is well known and is covered by U.S. Pat. No. Re. 29,638 also assigned to the assignee of the present invention. The disclosure of U.S. Re. Pat. No. 29,638 is incorporated herein by reference. Other equipment components such as a jar and a safety joint may be employed in the string of tools but are not illustrated in the drawings. A perforated tail pipe 14 may be connected to the lower end of the mandrel of the packer 12 to enable fluids in the well bore to enter the tools, and typical pressure recorders 15 are provided for the acquisition of pressure data during the test.

A full-bore sampler and safety valve 20 that is constructed in accordance with the principles of the present invention is connected in the pipe string just above the main test valve assembly 13. As shown in detail in FIGS. 2A–2E, the valve assembly 20 includes a tubular housing indicated generally at 25. The housing 25 includes several sections that are threaded together including an upper sub 27, an upper drain housing 28, a sampler housing 29, a lower drain housing 20 and a lower sub 31. The lower sub 31 as well as the upper sub 27 are provided with suitable male and female threads (such as the male threads 26 shown on the lower sub) by which the apparatus is connected into the tool string. Upper and lower vertically spaced ball valve assemblies 32 and 33 are rotatably mounted on a mandrel assembly indicated generally at 34 that is axially slidable within the housing 25 between a lower position as shown in the drawings where the respective ball valves are open, and an upper position where the valves simultaneously are rotated closed. When the valve assemblies 32 and 33 are closed, the interior region 35 therebetween as well as the annular spaces between the mandrel assembly 34 and the housing 25 form a sample chamber for entrapping a volume of formation fluid. The apparatus also functions as a safety valve since closure of the ball valves shuts off the throughbore of the tool string to fluid flow.

Figure 2A:
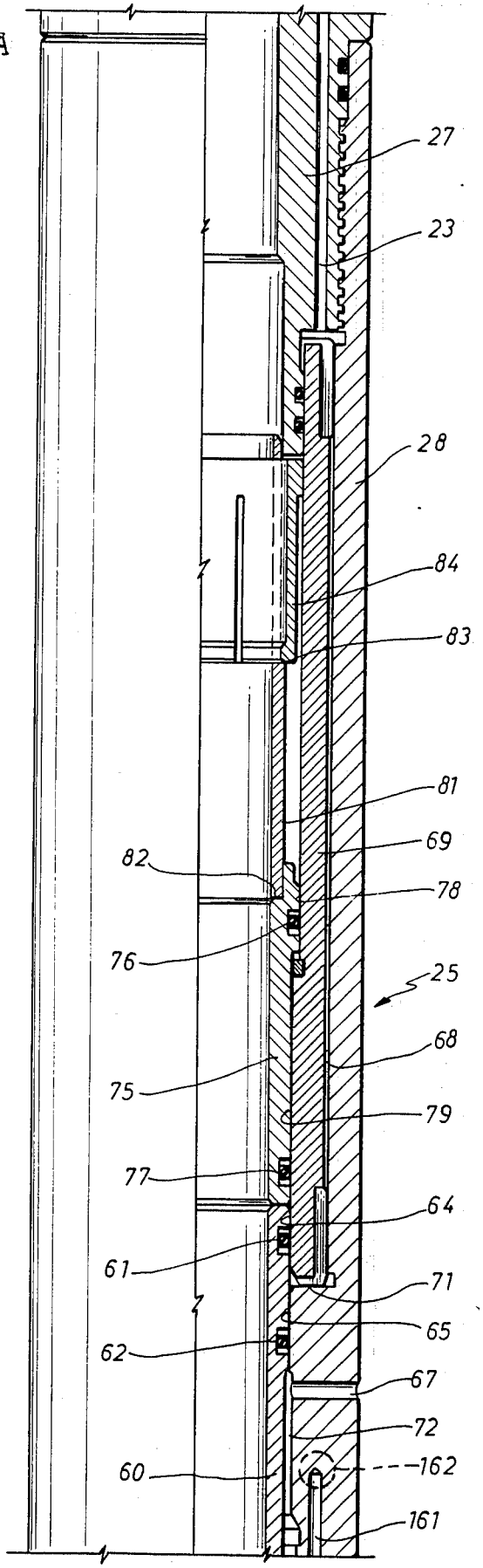
FIGS. 2A–2E are longitudinal sectional views, with portions in side elevation, of a full bore sampler and safety valve constructed in accordance with the principles of the present invention.
Figure 2B:
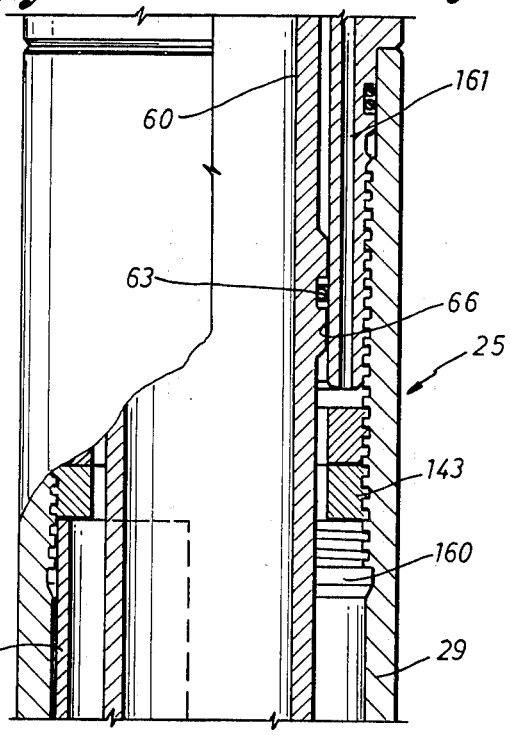
Figure 2C:
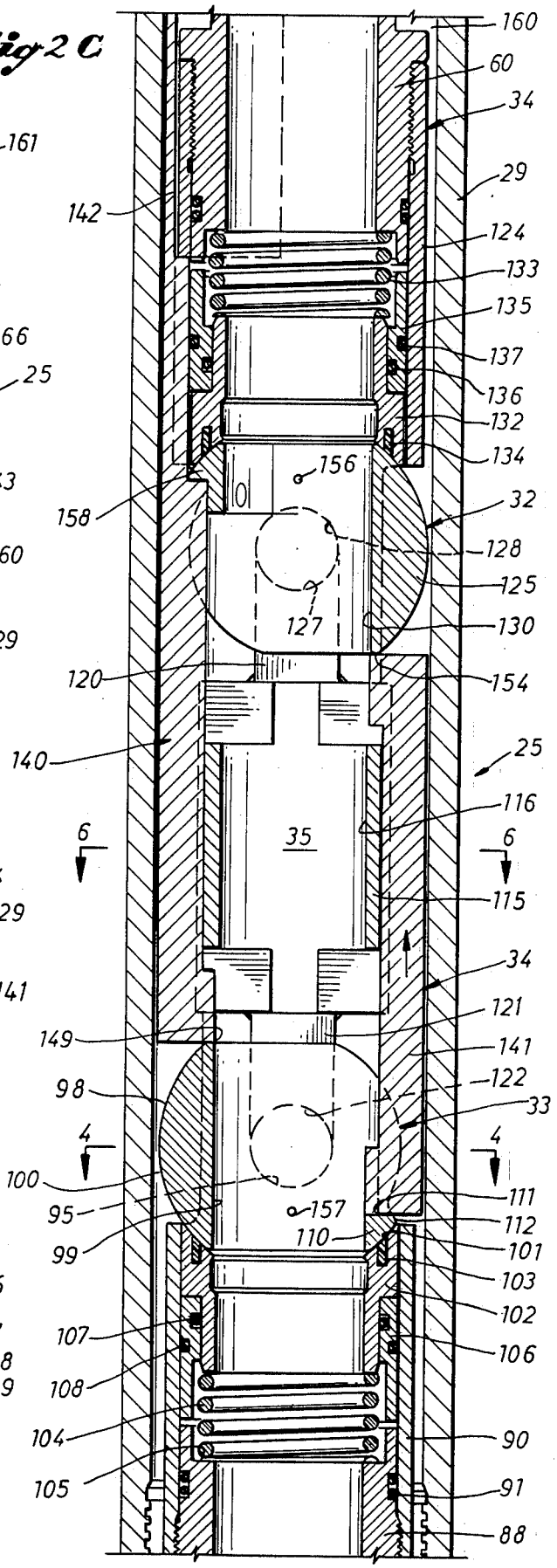
Figure 5:
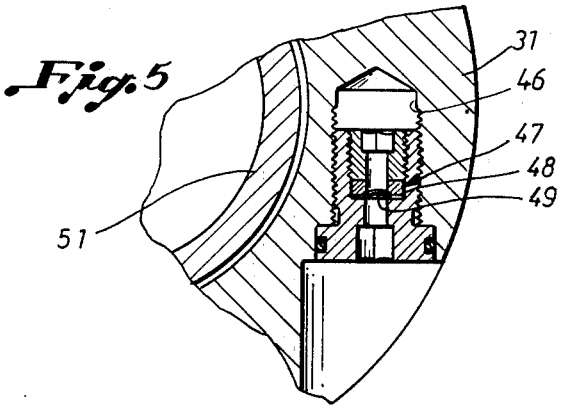
FIG. 5 is an enlarged fragmentary view of a rupture disc assembly.
Figure 2D:
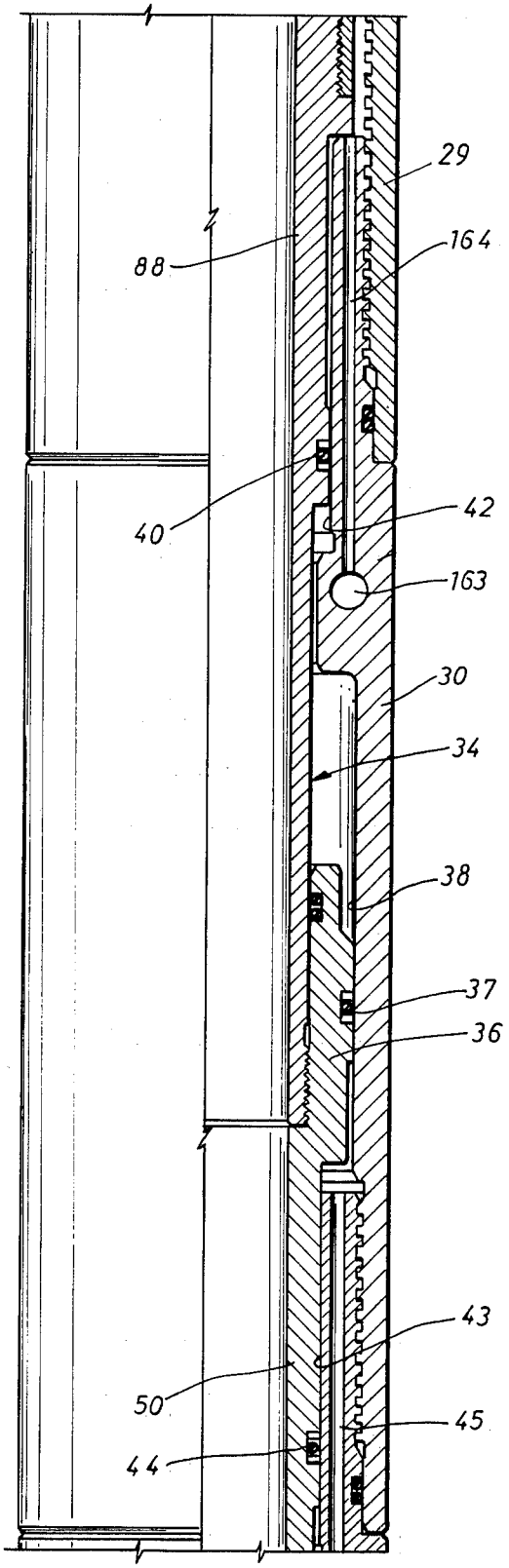

As shown in FIG. 2D, the lower section 50 of the mandrel assembly 34 is provided with an annular piston 36 which carries a seal 37 that engages the inner wall surface 38 of the lower drain housing 30. The mandrel assembly 34 also carries seals 40 and 44 that engage wall surfaces 42 and 43 of the lower drain housing 30 and the lower sub 31, respectively, with the surfaces 42 and 43 being formed with the same diameter. Initially, the annular chamber above and below the piston 36 contain air at atmospheric pressure. The lower annular chamber is in communication with a pressure channel 45 that terminates in an outwardly directed threaded port 6 (FIG. 2E) which normally is closed by a rupture disk assembly 47 shown in FIG. 5. As will be recognized by those skilled in the art, the rupture disk 48 in the assembly 47 will remain intact until a predetermined pressure is applied thereto which causes the central portion 49 of the disk to fail and thereby admit annulus fluids under pressure into the annular chamber below the piston 36.

Figure 2E:
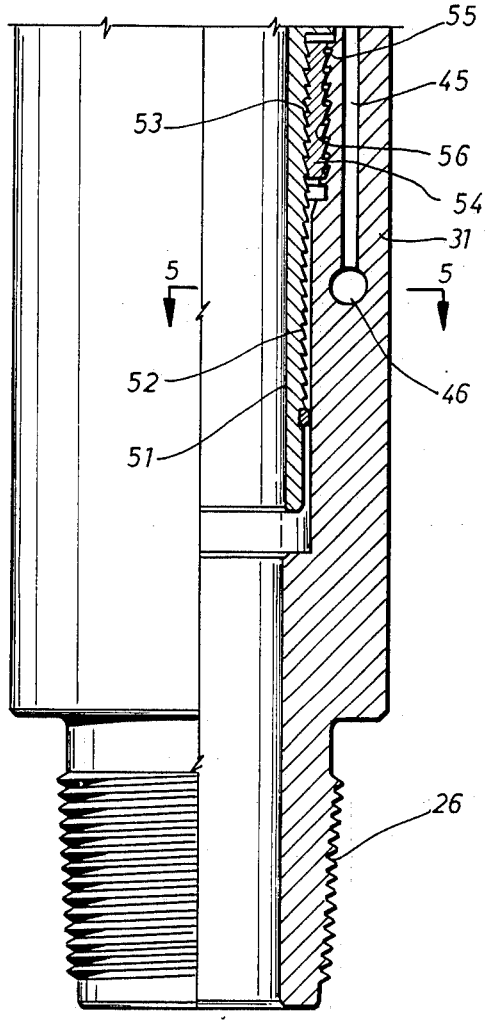
Figure 6:
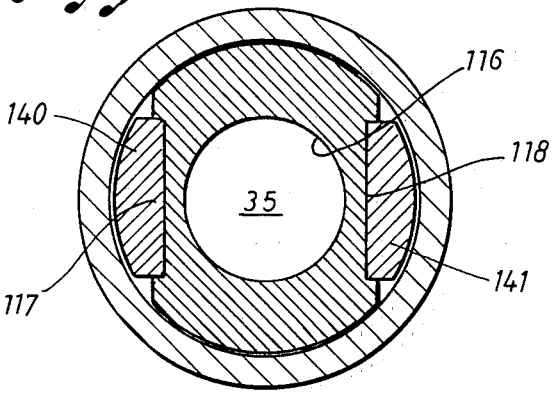
FIG. 6 is a cross-sectional view taken along line 6—6 of FIG. 2C.

As shown in FIG. 2E, the lower section 50 of the mandrel assembly 34 is provided with a reduced diameter skirt 51 having downwardly facing threads 52 that engage the upwardly facing teeth 53 of a split clutch ring 54 which is mounted on the lower sub 30. The clutch ring 54 has tapered outer surfaces 55 that engage companion surfaces 56 formed on the inner wall surfaces of the lower sub, so that during upward movement of the mandrel assembly 34 the skirt 51 will simply ratchet through the clutch nut 54. However, downward movement of the mandrel assembly 34 with respect to the housing is precluded by the clutch nut.

An upper section 60 of the mandrel assembly 34, as shown in FIGS. 2A and 2B is provided with three vertically spaced seal rings 61, 62, 63 that engage inner wall surfaces 64, 65 and 66 of the upper drain housing 28. A port 67 extends laterally through the wall of the housing 28, and an associated annular pressure channel 68 extends upwardly between an internally mounted sleeve 69 and the upper portion of the drain sub 28 where the channel may be communicated by a vertical port 23 in the upper sub 27 with the pressure operated piston or the like in an associated pressure controlled well tool 21 (FIG. 1) such as a reversing valve. The upper and middle seal rings 61, 62 normally are positioned respectively above and below the inlet 71 to the channel 68, as shown, to blank off the same, whereas the middle and lower seal rings 62, 63 normally are located respectively above and below the lateral port 67 to blank it off to fluid flow. The diameter of the wall surface 65 engaged by the seal 62 is somewhat smaller than the diameter of the wall surface 66 engaged by the seal 63, whereby fluid pressure in the well annulus applies a downwardly directed bias force to the section 60 of the mandrel assembly 34. When the mandrel assembly 34 is shifted upwardly within the housing 25 as previously mentioned, the middle seal 62 moves above the inlet port 71 to a position where the annular clearance space 72 communicates this inlet port with the inlet port 67 to enable well annulus pressure, and changes in such pressure, to be applied to the associated well tool 21 for the purpose of operating or controlling the same.

A bias mandrel 75 is slidably mounted within the bore of the sleeve 69 and carries seals 76 and 77 that engage adjacent inner wall surfaces 78 and 79 of the sleeve 69. The upper seal 76 has substantially the same seal diameter as other seals (such as at 40, 42 and 44) carried by the mandrel assembly 34 so that prior to actuation of the ball valve assemblies 32 and 33 the mandrel assembly is balanced with respect to internal fluid pressures. A holding sleeve 81 having its lower end engaging an upwardly facing shoulder 82 on the bias mandrel 75 is provided with an inclined outer surface 83 which engages the lower end of a collet 84 having slots that divide its lower end portion into a plurality of laterally flexible spring fingers. The resistance to outward flexure of the spring fingers provides a releasable means for holding the mandrel assembly 34 in the lower position until it is desired to shift the same upwardly and close the ball valve assemblies 32 and 33.

Figure 4:
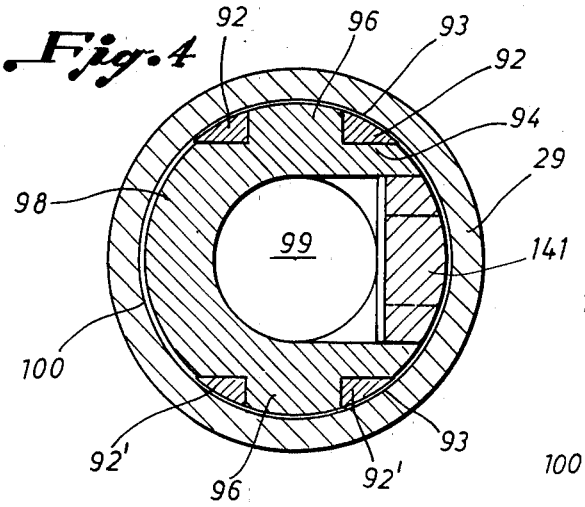
FIG. 4 is a cross-sectional view taken along line 4—4 of FIG. 2C.
Figure 3:
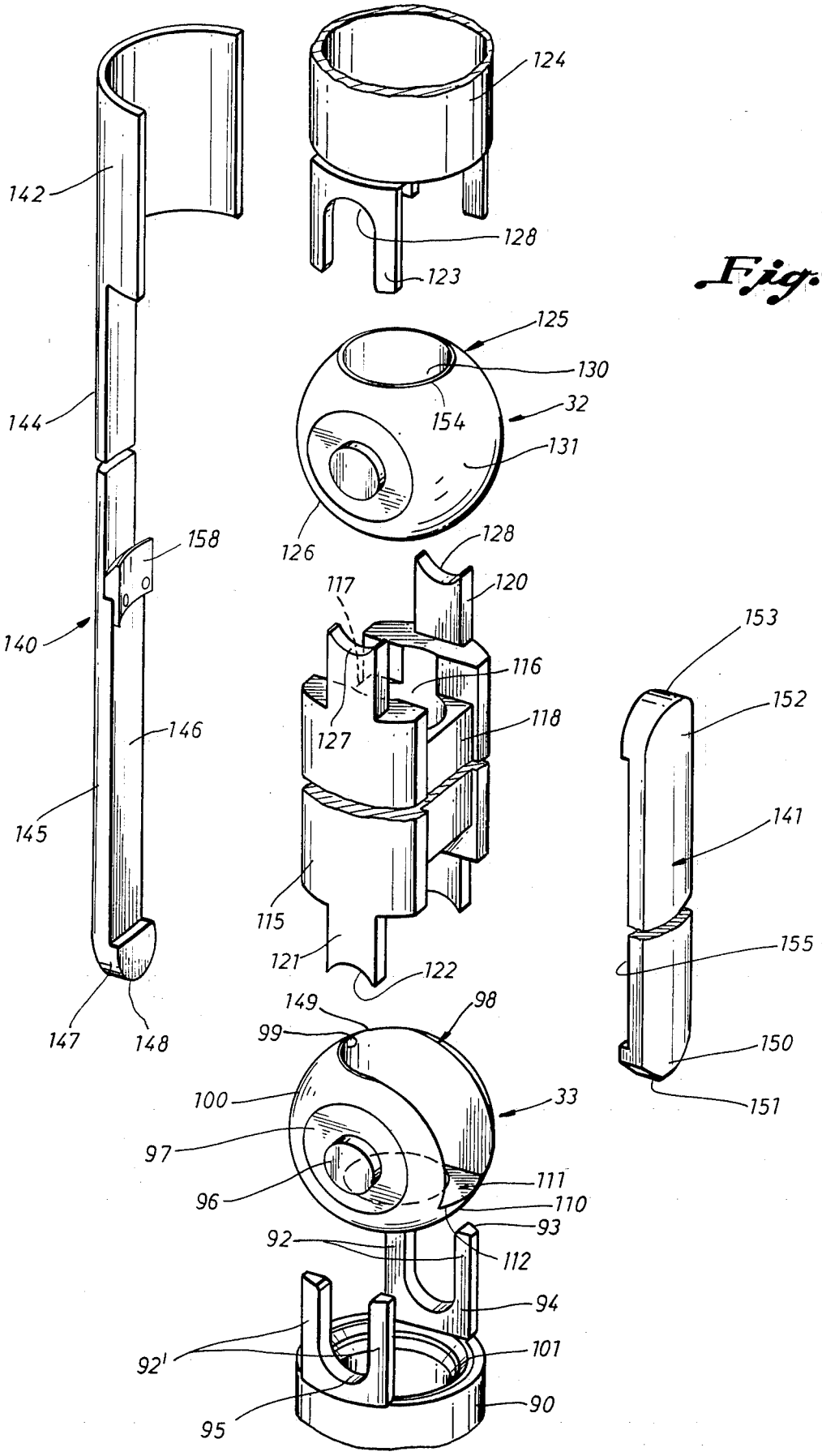
FIG. 3 is an exploded isometric view of certain valve components of FIG. 2.

As shown in FIGS. 2C, the intermediate section 88 of the mandrel assembly 34 has an outer ball cage 90 threaded to its upper end and sealed by O-rings 91. As shown in FIGS. 3 and 4, the upper end portion of the ball cage 90 has diametrically-spaced pairs of arms 92, 92′ that extend upwardly on the opposite sides of the cage, with the outer surfaces 93 of each arm being arcuate and the inner surface 94 thereof being flat. The upwardly-facing lower wall surfaces 95 between the respective pairs of arms 92, 92′ have a semi-circular shape and are complementally shaped and arranged to rotatably receive a pair of axially-aligned, transverse trunnions 96 that extend from the opposite side walls 97 of the lower ball element 98 as shown in FIG. 3. The ball element 98 has an interior bore 99 extending therethrough that when aligned with the central axis of the mandrel assembly 34 provides an open path for the flow of well fluids. However, when the ball element 98 is rotated 90° counterclockwise from the position shown, in FIG. 2C the spherical outer surface 100 of the mid-portion of the ball is brought into engagement with the complementally-shaped, spherical upper surface 101 of a valve seat ring 102 in order to shut off fluid flow. The seat ring 102 carries a seal assembly 103 to prevent fluid leakage, and is biased toward the ball element 98 by a coil spring 104 (FIG. 2C) that reacts between the lower end of the ring and an upwardly facing shoulder 105 on the mandrel section 88. A floating piston 106 having inner and outer seals 107, 108 prevents fluid leakage between the seat ring 102 and the annular space outside the lower valve cage 90.

As shown in FIG. 3, the side of the ball element 98 that is opposite from the solid section 100 is cut away to define an upwardly-opening, laterally facing opening or recess which extends along a substantial portion of the axial length of the ball element. However, there remains a circumferentially continuous semi-spherical portion 110 at the lower end of the ball element 98. The semi-spherical portion 110 may have a flat or a rounded upwardly facing wall surface or transverse edge portion 111 defining the lower surface of the above-described opening or recess, as well as a rounded outer edge 112. The side wall surfaces 97 of the ball element from which the trunnions 96 project preferably are flat as shown in the drawings.

An inner valve cage member 115 is positioned within the bore of the sampler housing section 29 and has a central bore 116. The cage member 115 is generally tubular, but is provided with flat wall surfaces 117 and 118 on the opposite sides thereof which serve as actuator guides as will be explained below. A diametrically-spaced pair of legs 121 depend from the lower end of the cage member 115 and are sized to fit snugly between the respective arms 92, 92' on the lower cage member 90. The legs 121 each have a semi-circular end surface 122 that fits against the upper surfaces of the trunnions 96 on the ball element 98 in order to rotatably mount the same in a rugged and sturdy manner. Another diametrically-spaced pair of legs 120 having semi-circular upper surfaces 128 project upwardly from the upper end of the inner cage member 115 and are sized to fit snugly between the downwardly extending arms 123 of an upper cage member 124 that is threaded to the lower end of the mandrel section 60. The upper ball element 125 has the trunnions 126 that extend from the opposite side walls thereof confined between the opposed, upper and lower semi-circular surfaces 127, 128 of the respective pairs of legs and arms 120, 123 in order to securely mount the ball element for rotation about a transverse axis between an open position where the central bore 130 thereof is axially aligned with the central axis of the mandrel assembly 34, and a closed position where the outer spherical wall surface 131 thereof engages an upper seat ring 132 (FIG. 2C). The seat ring 132 is biased toward the ball element 125 by a coil spring 133, and a seal assembly 134 is provided to prevent fluid leakage. A floating piston 135 having seals 136, 137 prevents fluid leakage between the seat ring 132 and the upper cage member 124. In the same fashion as the ball element 98, the side of the ball element 125 opposite the surface 131 thereof is similarly cut away for a substantially part of the axial length of the ball element as shown in FIGS. 2C and 3 to define a downwardly-opening, laterally-facing opening or recess.

In order to simultaneously rotate the ball elements 125 and 98 from their open positions to their closed positions, actuator members 140 and 141 are provided. The actuator member 140 includes an upper arcuate portion 142 whose upper end surface abuts against a stop nut means 143 (FIG. 2B) in order to preclude upward movement, and a reduced central portion 144 that extends downwardly between the sampler housing 29 and the cage member 124. The lower portion 145 of the actuator member 140 has a flat inner wall surface 146 that is arranged to slide with respect to the outer wall surface 117 of the inner cage member 115, and a lower nose 147 that has a rounded end surface 148 that bears against the upper edge 149 of the continuous spherical portion of the lower ball element 98. The other actuator member 141 has a lower nose 150 with an end surface 151 that bears against the upper upwardly-facing transverse edge portion 111 on the lower semi-spherical end portion 110 of the lower ball element 98, and an upper rounded nose 152 having a rounded end surface 153 that bears against the transverse edge portion 154 on the lower end of the upper ball element 125. The actuator member 141 also has a flat inner wall surface 155 that is slidable relative to the outer wall surface 118 of the inner cage member 115.

If desired, the ball elements 125 and 98 can be releasably held in the open position by small shear pins 156, 157 (FIG. 2C) that extend from one leg of the upper and lower cage members into apertures in the sides of the ball members.

It will be recognized that when the ball elements 98 and 125 are closed, the region 35 between the ball elements and the annular spaces outside the mandrel from the seal 63 down to the seal 40 provide a chamber for trapping a flowing sample of formation fluids. The annular space 160 located between the mandrel assembly 34 and the inner wall of the housing section 29 above the upper ball vavle element 125 is communicated by a vertical passage 161 (FIG. 2B) to a typical drain plug assembly 162 (FIG. 2A) that enables the sample of formation fluids trapped in the chamber to be removed when the tool has beeen removed from the well. An identical drain plug assembly 163 may be located in the wall of the sampler housing section 29 at the lower end of a vertical passage 164 as shown in FIG. 2D.

OPERATION

In operation, the sampler-safety valve apparatus 20 assembled as shown in the drawings is incorporated into the string of drill stem testing tools above the main test valve 13, and the string is run into the well on the pipe string 11. During running of the tools and operation of the test valve 13, the ball valve elements 125 and 98 are in their open positions as shown in FIG. 2C. The enclosed regions above and below the piston 36 initially contain air at atmospheric pressure, so that the mandrel assembly 34 is subjected only to the downward bias forces on the bias mandrel 75 and the upper mandrel 60 which tend to maintain the valves open.

The rupture disk 48 is selected to have a burst pressure rating such that it will remain intact during all of the annulus pressure changes that are employed to operate the main test valve 13. However, when it is desired to terminate the test and obtain a sample, a pressure increase in excess of that employed to activate the test valve 13 is applied at the surface to the well annulus 22. Such pressure increase ruptures the central region 49 of the disk 48 to admit annulus fluid via the passage 45 into the region below the piston 36 on the mandrel assembly 34. Upward force on the piston 36 due to such pressure will cause the mandrel assembly 34 to shift upwardly within the housing 25, causing both of the valve elements 125, 98 to be rotated simultaneously to their closed positions to trap a sample of formation fluids in the chamber 35 in the following manner. As the mandrel assembly 34 shifts upwardly, the lower end of the actuator member 140, which is being held stationary in the housing member 29 through engagement with the stop nut 143, bears against the upper edge 149 of the lower ball element 98 and causes the same to rotate about the transverse axis defined by the trunnions 96 toward closed position. As the ball element 98 rotates, the actuator member 141 is shifted upwardly by the upwardly-facing surface of the transverse edge portion 111 of the ball element which bears against the lower surface 151 of the actuator 141. Upward shifting of the actuator member 141 causes its upper surface 153 to bear against the lower edge 154 of the upper ball element 125 to rotate the ball element toward its closed position. As the lower ball element 98 rotates, the lower end portion of the actuator member 140 is "swallowed" by the recess or opening on the open side of the ball element, and the upper portion of the actuator member 141 is similarly swallowed by the side opening in the upper ball element 125. When the mandrel assembly 34 has moved fully upward and the piston section 36 has stopped against the inwardly directed shoulder immediately thereabove, the outer surface 131 of the upper ball element 125 will have rotated into seated position against the seat ring 132, and the outer surface 100 of the lower ball element 98 will have rotated into seated position against the lower seat ring 102. The valve assemblies 32 and 33 thus are closed to prevent flow through the tool and to trap a sample of formation fluids in the bore 35 and the annular spaces outside the actuator mandrel 34 as discussed above. The mandrel section 51 ratchets upwardly within the lock ring 54 so as to lock the sampler closed. The port 67 in the upper section 28 of the housing 25 is communicated with the vertical passage 68 via the clearance spaces 72 and 71 to enable operation of associated equipment in response to subsequent changes in the well annulus pressure.

When the tool string has been removed from the well, the sample trapped in the chamber 35 and in the annular spaces outside the mandrel assembly 34 can be removed by hooking up a drain line to the threaded port 162 and then opening the drain valve.

The apparatus of the present invention also functions as a safety valve because the throughbore of the tool string can be closed at any time in response to the specific pressure signal required to disrupt the rupture disc. It also will be recognized that the ball valves 32 and 33 have an outstanding capability for cutting a wireline that may be extending therethrough where the valves must be closed quickly in the event of an emergency, or where a wireline tool has become hung in the tool string below the sampler. The valve assemblies 32 and 33, being trunnion mounted, extremely sturdy and rugged and are not subject to cocking in operation. The valves thus operate with lower friction than prior devices. The unique actuator system of the present invention applies high closing torque to the ball elements by virtue of engagement with outer peripheral edges thereof. Such high closing torque assures complete closure of the ball elements even in the presence of junk or debris particles.

The term "full-opening" as used herein means that the valve element when open provides an axial passage of a diameter at least as great as the inner diameter of the pipe string on which the tools are suspended.

It will now be apparent that a new and improved full bore sampler-safety valve apparatus has been disclosed. Since certain changes or modifications may be made by those skilled in the art without departing from the inventive concepts involved, it is the aim of the appended claims to cover all such changes and modifications falling within the true spirit and scope of the present invention.

What is claimed is:

1. A well tool adapted to be connected in a pipe string and positioned in a well bore for collecting a sample of fluids within said pipe string and comprising: an outer tubular member:

first and second inner members cooperatively arranged within said outer member for defining an axial passage therein and enabling at least said first inner member to move longitudinally within said outer member;

valve means controlling communication through said axial passage and including first and second valve members cooperatively mounted on said first and second inner members and respectively arranged to pivot about a transverse axis between a passage-opening position and a passage-closing position, each of said valve members having an outwardly-facing opening bounded by first and second transverse edge portions that are spatially disposed on opposite sides of said transverse axis of that valve member and laterally offset therefrom;

pressure-responsive means cooperatively arranged for moving said first inner member longitudinally within said outer member;

first actuator means on said outer member and cooperatively arranged to be engaged with said first transverse edge portion of said first valve member upon longitudinal movement of said first inner member for rotating said first valve member to its said passage-closing position; and second actuator means on said outer member and cooperatively arranged to be engaged with said second transverse edge portion of said first valve member upon rotation thereof toward its said passage-closing position and moved against said first transverse edge portion of said second valve member for rotating said second valve member to its said passage-closing position.

2. The well tool of claim 1 wherein said valve members are substantially in contact with said second actuator means so that said valve members will be simultaneously rotated to their said passage-closing positions upon longitudinal movement of said first inner member.

3. The well tool of claim 1 further including means on said outer member cooperatively arranged to prevent retrograde longitudinal movement of said first inner member for retaining said valve members in their said passage-closing positions.

4. A well tool according to claim 1, claim 2 or claim 3 wherein those portions of said first and second actuator means respectively adjacent to said openings are cooperatively sized and shaped to be at least partially received therein upon rotation of said valve members to their said passage-closing positions.

5. The well tool of claim 1 wherein said second inner member is also cooperatively arranged to move longitudinally within said outer member; and further including a third inner member cooperatively arranged within said outer member and between said first and second inner members and adapted for simultaneously moving said second inner member upon longitudinal movement of said first inner member by said pressure-responsive means.

6. The well tool of claim 1 further including first and second annular valve seats on said first and second inner members respectively cooperating with said first and second valve members tro block communications through said axial passage upon rotation thereof to their said respective passage-closing positions.

7. A full-bore well tool adapted to be connected to a pipe string and positioned in a well bore for collecting a sample of formation fluids within said pipe string and comprising: a tubular housing;

a mandrel assembly defining a full-bore axial passage in said housing and cooperatively arranged for axial movement therein between longitudinally-spaced first and second positions;

full-opening valve means adapted for controlling communication through said axial passage and including upper and lower ball members cooperatively mounted on upper and lower portions of said mandrel assembly and respectively arranged for rotation about a transverse axis from a passage-opening position to a passage-closing position, each of said ball members having an outwardly-opening recess in one side thereof which, together with the outer surface on the opposite side of that ball member, defines a first transverse edge portion across one end of that ball member that is laterally offset to one side of said rotational axis and longitudinally spaced from a second transverse edge portion across the outer surface on the other end of that ball member and laterally offset to the other side of said rotational axis;

actuating means responsive to well bore pressures outside of said housing for selectively moving said mandrel assembly from its said first position to its said second position;

means cooperatively arranged between one side of said housing and one of said ball members and adapted to engage said first transverse edge portion thereof for imparting sufficient torque to said one ball member to rotate said one ball member from its said passage-opening position to its said passage closing position upon movement of said mandrel assembly to its said second position; and means cooperatively arranged on the other side of said housing between said ball members and adapted to be moved by said second transverse edge portion of said one ball member against said first transverse edge portion of said other ball member for imparting sufficient torque to said other ball member to rotate said other ball member from its said passage-opening position to its said passage closing position upon movement of said mandrel assembly to its said second position.

8. The full-bore well tool of claim 7 wherein said actuating means comprising first and second actuators which are substantially in contact with said transverse edge portions of said ball members so that said ball members will be simultaneously rotated to their respective passage-closing positions upon longitudinal movement of said mandrel assembly.

9. The full-bore well tool of claim 8 further including locking means cooperatively arranged between said mandrel assembly and said housing for locking said mandrel assembly in its said secondposition and thereby preventing the subsequent return of said ball members to their respective passage-opening positions.

10. The full-bore well tool of claim 8 wherein those portions of said first and second actuators respectively adjacent to said ball members and said outwardly-opening recesses are complementally sized and shaped to permit at least the partial reception of those portions of said actuators within said recesses upon rotation of said ball members to their said passage-closing positions.

11. A well tool adapted to be connected in a pipe string and positioned in a well bore for collecting a sample of fluids within said pipe string and comprising:

inner and outer tubular members telescopically arranged together for defining an axial passage therein and movable longitudinally relative to one another between spaced first and second operating positions;

valve means controlling communications through said axial passage including an annular valve seat coaxially mounted on said inner member, and a ball member having an axial flow passage therein cooperatively engaged with said valve seat and mounted on said inner member for rotation about a transverse pivotal axis between a passage-opening position where one end surface of said ball member around one end of said axial flow passage engages said valve seat and a passage-closing position where one side surface of said ball member engages said valve seat, said ball member further including an outwardly-facing opening in the other side surface of said ball member that is bounded at one end by a transverse edge portion that is defined by the intersection of the other end of said axial flow passage with said one side surface and is spatially disposed on one side of said pivotal axis; and valve-actuator means including a first actuator member cooperatively arranged within said outer member for moving said inner member longitudinally therein, and a second actuator member cooperatively arranged within said outer member and adapted upon longitudinal movement of said inner member in one direction to be engaged by said transverse edge portion of said ball member and to be progressively received within said other end of said axial flow passage and said outwardly-facing opening for rotating said ball member from its said passage-opening position to its said passage-closed position.

12. A full-bore well tool adapted to be connected in a pipe string and positioned in a well bore for collecting a sample of formation fluids within said pipe string and comprising:

a tubular housing;

a mandrel assembly defining a full-bore axial passage in said housing and cooperatively arranged for axial movement therein between longitudinally-spaced first and second positions;

full-opening valve means adapted for controlling communication through said axial passage and including upper and lower valve seats coaxially mounted on upper and lower portions of said mandrel assembly, and upper and lower ball members having axial flow passages cooperatively engaged with said upper and lower valve seats and mounted on said mandrel assembly for independent rotation about upper and lower transverse pivotal axes between a passage-opening position where said axial flow passages in said ball members are aligned with said full-bore axial passage and a passage-closing position where said axial flow passages in said ball members are not aligned with said full-bore passage, each of said ball members having one end surface thereof around one end of its axial flow passage that is engaged with its associated valve seat when said ball member is in its said passage-opening position and one side surface thereof that is engaged with its associated valve seat when said ball member is in its said passage-closing position, each of said ball members further including an outwardly-facing opening in the other side surface thereof having a first transverse edge portion spatially disposed to one side of its said pivotal axis and at the intersection of the other end of said axial flow passage with said one side surface and a second transverse edge portion spatially disposed to the other side of its said pivotal axis and at the intersection of said opening with said other side surface;

means cooperatively arranged on said housing for selectively moving said mandrel assembly from its said first position to its said second position;

a first actuator cooperatively arranged on one side of said housing between said upper and lower ball members and adapted upon movement of said mandrel assembly toward its said second position to be engaged by said first transverse edge portion of one of said ball members and to be progressively received within the adjacent portions of its said axial flow passage and its said opening for imparting sufficient torque thereto to rotate said one ball member from its said passage-opening position to its said passage-closing position; and a second actuator cooperatively arranged on the other side of said housing between said upper and lower ball members and adapted upon movement of said mandrel assembly toward its said second position to be engaged by said second transverse edge portion of said one ball member and moved thereby against said first transverse edge portion of said other ball member and to be progressively received within the adjacent portions of its said axial flow passage and its said opening for imparting sufficient torque thereto to rotate said other ball member from its said passage-opening position to its said passage-blocking position.

13. The full-bore well tool of claim 12 wherein said first and second actuators are substantially in contact with said transverse edge portions of said ball members respectively when said mandrel assembly is in its said first position so that said ball members will be simultaneously rotated to their respective passage-closing positions upon movement of said mandrel assembly to its said second position.

14. The full-bore well tool of claim 14 further including means cooperatively arranged between said mandrel assembly and said housing for securing said mandrel assembly in its said second position.

* * * * *